United States Patent [19]

King

[11] 4,241,440

[45] Dec. 23, 1980

[54] BATTERY-CONTAINING CROWN FOR WRISTWATCHES

[75] Inventor: Josef King, Schramberg, Fed. Rep. of Germany

[73] Assignee: Gebrüder Junghans GmbH, Schramberg, Fed. Rep. of Germany

[21] Appl. No.: 6,211

[22] Filed: Jan. 24, 1979

[30] Foreign Application Priority Data

Feb. 25, 1978 [DE] Fed. Rep. of Germany ..... 2808217

[51] Int. Cl.[3] ..... G04B 1/00

[52] U.S. Cl. ..... 368/204; 368/203

[58] Field of Search ..... 58/23 BA, 88 B, 88 R, 58/23 R; 368/203, 204

[56] References Cited

U.S. PATENT DOCUMENTS 3,670,491 6/1972 Weschler ..... 58/23 BA

*Primary Examiner*—Gene Z. Rubinson
*Assistant Examiner*—John B. Conklin
*Attorney, Agent, or Firm*—Burns, Doane, Swecker & Mathis

[57] ABSTRACT

A voltage source is arranged within the stem control crown of a timekeeping watch. The crown is designed similar to a knob shell and forms a component of the electric circuit of the watch. This specific battery arrangement allows an easy exchange of batteries, even by unskilled persons, and makes furthermore feasible, a more compact arrangement and miniaturization of the individual watch components.

11 Claims, 3 Drawing Figures

BATTERY-CONTAINING CROWN FOR WRISTWATCHES

BACKGROUND AND OBJECTS OF THE PRESENT INVENTION

The invention relates to an arrangement of a voltage source for a timekeeping watch of the type having at least one regulating knob or crown connected to a stem and wherein the voltage source is directly accessible outside of the watch.

The published German patent application 19 54 776 discloses the arrangement of a watch battery which is accessible from the outside of a watch, making it possible, even for a person not technically inclined, to replace the battery without endangering the clockwork, for example with the aid of a coin. However, this arrangement has the disadvantage, like all other known conventional battery arrangements, that space is required for the battery and is taken up within the area of the clockwork proper. As a result thereof, the designer of such watch will be limited in his choices of possible layouts, leading in many instances to very compact and costly types of construction.

It is, therefore, an object of the invention to overcome this disadvantage in the case of a battery arrangement of the above-defined type.

It is another object of the invention to propose a novel battery arrangement for a watch.

BRIEF SUMMARY OF THE INVENTION

These objects are achieved by the present invention which involves an electrical timekeeping watch of the type including a casing, a control stem mounted in the casing, a manually manipulable regulating crown connected to the stem for actuating the latter, and an electronic circuit including a voltage source which is accessible externally of the casing. The improvement resides in that the voltage source is contained within the crown. In this fashion, the watch can be made smaller, if desired, and a relatively simple exchange of batteries is afforded.

BRIEF SUMMARY OF THE DRAWING

Other objects and advantages of the present invention will become apparent from the subsequent detailed description of a preferred embodiment thereof, in connection with the accompanying drawings, in which like numerals designate like elements and in which.

DETAILED DESCRIPTION OF PREFERRED EMBODIMENTS OF THE INVENTION

Figure 1:
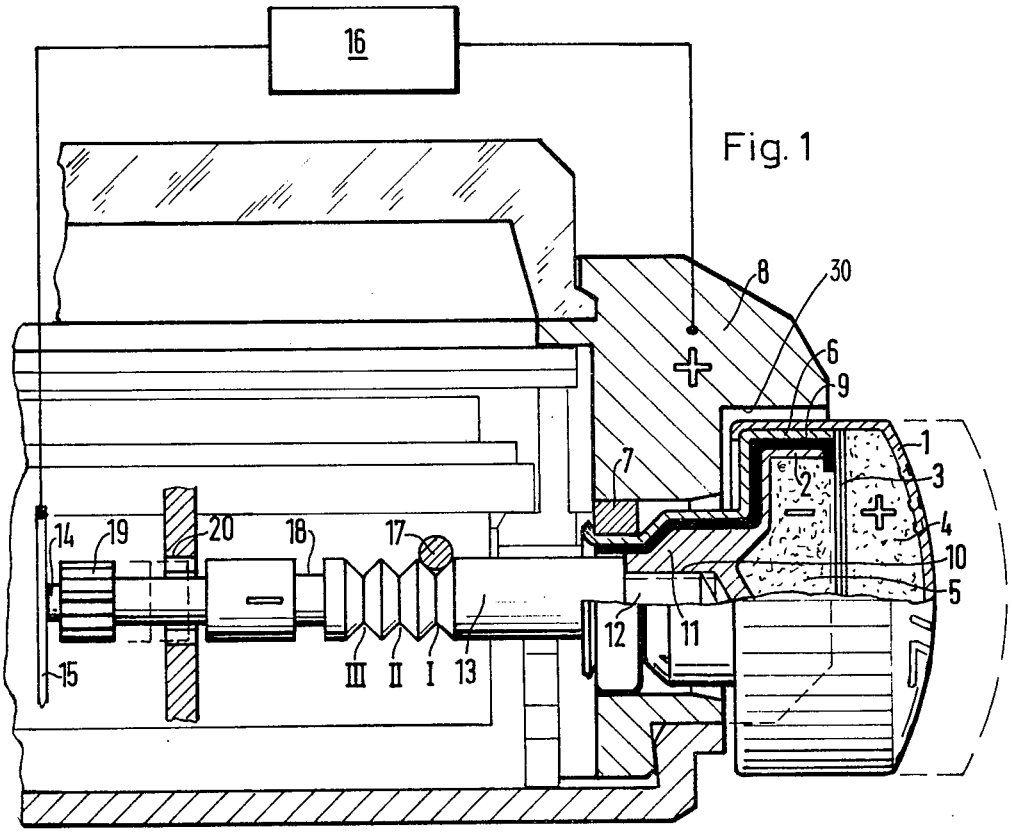
FIG. 1 is a partial sectional view of an electronic wristwatch taken along line 1—1 of FIG. 3.

The basic structure of the crown proposed by the invention, hereinafter referred to by the term battery crown, is similar to a standard knob shell. The metallic cups 1 and 2 form, with the aid of a partition 3, two chambers 4 and 5 for housing chemical compounds of negative and positive potentials such as zink or lithium and monofluorographite $[(CF_x)_n]$ or silverchromate $[AG_2CRO_4]$. A sleeve 6, used for manufacturing and engineering reasons as an extension of cup 1 connects the positive potential to the casing mass 8 by way of a conductive gasket 7 formed of electrically conductive silicone rubber material. A cup 9 insulates the cups 1 and the sleeve 6 from the cup 2. The battery crown thus formed is screwed onto a threaded stub 12 of a stem 13 by means of a thread 10 in an extension 11 of the cup 2. A plate spring 15 which is electrically connected with the electronic drive system 16, the latter connected to the casing mass 8, rests against an end 14 of the stem. A stationary stop-spring 17 releasably holds the stem 13 in one of three axial positions defined by locking grooves I, II, III.

When the stem 13 is positioned in its extreme, inner groove I (see FIG. 1), it is in its normal position where it will not perform any mechanical function.

By pulling the stem from the watch into the next locking groove II, it becomes possible to regulate the hands by way of a conventional (not illustrated) lever arrangement which will engage a groove 18.

If the stem 13 is pulled fully from the watch, that is, into groove III, its toothing 19 will engage a geared coupling 20, thereby preventing any turning of the stem 13. This makes it possible to unscrew a depleated battery crown from the threaded stub 12 without the use of additional means. By screwing-on a new battery crown (depicted in FIG. 2), onto the stub 12, the watch again becomes operational.

Naturally, it is also possible to use several battery crowns connected in parallel. In this case, only one battery crown will function as a regulating crown and the other battery crown or crowns can then be designed in the form of a push button (or buttons), with the stem 13 replaced by a guide stem. Such stem must serve as a current conductor but it can also perform, in addition thereto, a mechanical function.

Figure 2:
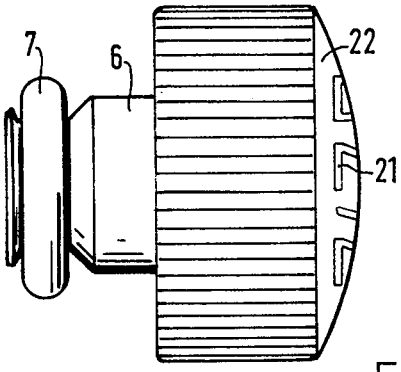
FIG. 2 is a side view of a regulating crown as proposed by the invention.

In the case of a particularly advantageous further embodiment of the invention, there is punched into the front portion 22 of the battery crown, as indicated in FIG. 2 by numeral 21, the date (month and year) when the battery crown is likely to be depleted, requiring its replacement.

Figure 3:
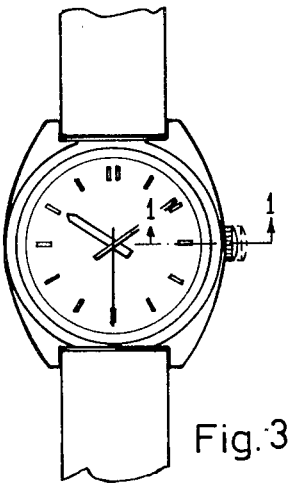
FIG. 3 depicts a wristwatch for men in actual size, having a crown as proposed by the invention.

FIG. 3, which illustrates in its natural size and proportions a wristwatch for men, demonstrates the fact that the crown, with its diameter enlarged to 6 mm, will not significantly affect the general appearance of the watch, especially because it is feasible to make the crown less visible by means of a recess 30 within the casing.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In an electrical timekeeping watch of the type including a casing, a control stem mounted in the casing, a manually manipulatable regulating crown connected to the stem for actuating the latter, an electronic circuit and a voltage source for the circuit, which is disposed outside of said casing, the improvement wherein said voltage source is contained within said crown, said crown including electrical conductor means in sliding electrical contact with a component of said circuit when said crown is manipulated, said crown is threadedly connected to said stem, means on said casing for engaging said stem in a selected axial position of the latter to constrain said shaft against rotation, allowing said crown to be unthreaded from said stem while said stem remains in said casing.

2. Apparatus according to claim 1, wherein said crown comprises a first generally cup-shaped element, a second generally cup-shaped element mounted within said first cup-shaped element to form a space therebetween, insulation means for dividing said space into two electrically insulated chambers, said cup-shaped elements being electrically insulated from one another, said chambers containing voltage-generating substances, said stem and one of said elements being connected to said electric circuit.

3. Apparatus according to claim 2, wherein one of said elements constitutes an electrically negative pole and is threadedly connected to said stem.

4. Apparatus according to claim 2, wherein one of said cup-shaped elements constitutes an electrically positive pole and is electrically connected to said casing.

5. Apparatus according to claim 4, wherein said conductor means comprises an electrically conductive gasket disposed between said one cup-shaped element and said casing.

6. Apparatus according to claim 1, wherein said crown comprises a first generally cup-shaped element, a second generally cup-shaped element mounted within said first cup-shaped element to form a space therebetween, insulation means for dividing said space into two electrically insulated chambers, said cup-shaped elements being electrically insulated from one another, said chambers containing voltage-generating substances, said stem and one of said elements being electrically connected to said electric circuit, one of said elements constituting an electrically negative pole and being threadedly connected to said stem, the other of said elements constituting an electrically positive pole, an electrically conductive gasket disposed between an extension of said other element and said casing to form an electrical connection therebetween, said watch including a geared coupling, said stem being movable inwardly and outwardly relative to said casing and carrying a toothing which engages said geared coupling when said stem is at one end of its travel.

7. Apparatus according to claim 1, wherein said crown comprises a first generally cup-shaped element, a second generally cup-shaped element mounted within said first cup-shaped element to form a space therebetween, insulation means for dividing said space into two electrically insulated chambers, said cup-shaped elements being electrically insulated from one another, said chambers containing voltage-generating substances, said stem and one of said elements being electrically connected to said electric circuits, one of said elements constituting an electrically negative pole an being threadedly connected to said stem, the other of said elements constituting an electrically positive pole, and an electrically conductive gasket disposed between an extension of said other element and said casing to form an electrical connection therebetween, said crown having formed thereon the date of anticipated expiration of said voltage source.

8. Apparatus according to claim 1, wherein said crown is replaceable.

9. In an electrical timekeeping watch of the type including a casing, a control stem mounted in the casing, a manually manipulable regulating crown connected to the stem for actuating the latter, an electronic circuit and a voltage source for the circuit which is accessible externally of said casing, the improvement wherein said voltage source is contained within said crown, said crown comprising a first generally cup-shaped element, a second generally cup-shaped element mounted within said first cup-shaped element to form a space therebetween, insulation means for dividing said space into two electrically insulated chambers, said cup-shaped elements being electrically insulated from one another, said chambers containing voltage-generating substances, said stem and one of said elements being electrically connected to said circuit.

10. In an electrical timekeeping watch of the type including a casing, a control stem mounted in the casing, a manually manipulatable regulating crown connected to the stem for actuating the latter, an electronic circuit and a voltage source for the circuit, which is disposed outside of said casing, the improvement wherein said voltage source is contained within said crown, said crown including electrical conductor means in sliding electrical contact with a component of said circuit when said crown is manipulated, said crown comprising means forming two chambers which are electrically insulated from one another, one of said chambers containing a substance with a negative potential and the other chamber containing a substance with a positive potential.

11. In an electrical timekeeping watch of the type including a casing, a control stem mounted in the casing, a manually manipulatable regulating crown connected to the stem for actuating the latter, an electronic circuit and a voltage source for the circuit, which is disposed outside of said casing, the improvement wherein said voltage source is contained within said crown, said crown including electrical conductor means in sliding electrical contact with a component of said circuit when said crown is manipulated, said casing including a recessed portion receiving a portion of said crown.

* * * * *